US007345595B1

(12) United States Patent
Heckman, Jr.

(10) Patent No.: US 7,345,595 B1
(45) Date of Patent: Mar. 18, 2008

(54) SHORT DRIVEWAY VEHICLE MOTION DETECTOR

(75) Inventor: LeRoy F. Heckman, Jr., New Holland, PA (US)

(73) Assignee: Preferred Security Components, Inc of PA, Salunga, PA (US)

( * ) Notice: Subject to any disclaimer, the term of this patent is extended or adjusted under 35 U.S.C. 154(b) by 209 days.

(21) Appl. No.: 11/395,609

(22) Filed: Mar. 31, 2006

(51) Int. Cl.
*G08G 1/01* (2006.01)

(52) U.S. Cl. ..... 340/933; 340/941; 324/207.2

(58) Field of Classification Search ..... 340/933
See application file for complete search history.

(56) References Cited

U.S. PATENT DOCUMENTS 3,237,155 A * 2/1966 Brockett ..... 340/941
3,582,932 A * 6/1971 Chapman ..... 340/551
3,609,679 A * 9/1971 Updegraff et al. ..... 340/941
3,745,450 A * 7/1973 Wilt ..... 340/941
3,775,742 A * 11/1973 Koerner et al. ..... 340/938
4,079,322 A * 3/1978 Lawrence et al. ..... 340/989
4,449,115 A * 5/1984 Koerner ..... 340/941
4,920,340 A * 4/1990 Mizuno ..... 340/905
4,968,979 A * 11/1990 Mizuno et al. ..... 340/941
5,426,363 A * 6/1995 Akagi et al. ..... 324/239
5,455,768 A * 10/1995 Johnson et al. ..... 702/142
5,868,360 A * 2/1999 Bader et al. ..... 246/202
5,877,706 A * 3/1999 Summersgill ..... 340/933
6,166,660 A * 12/2000 Grenier ..... 340/932.2
6,816,086 B1 * 11/2004 Kieffer, Sr. ..... 340/933
6,870,488 B1 * 3/2005 Compton ..... 340/933
7,071,840 B2 * 7/2006 Allen et al. ..... 340/933

* cited by examiner

*Primary Examiner*—Benjamin C. Lee
*Assistant Examiner*—Eric M Blount
(74) *Attorney, Agent, or Firm*—Martin Fruitman

(57) ABSTRACT

The apparatus is a vehicle motion detection apparatus for short driveways which uses passive ferromagnetic detecting coils reacting to the fluctuation in the earth's magnetic field caused by moving vehicles. The preferred embodiment of the invention uses two sensor coils located on a line that is approximately perpendicular to the adjacent road and parallel to the driveway. The sensor coils are designed and connected so that they generate signals of opposite polarity so that together they cancel out the signals generated by vehicles on the road, but the signals generated by a vehicle moving on the driveway do not cancel each other and are electronically processed.

9 Claims, 1 Drawing Sheet

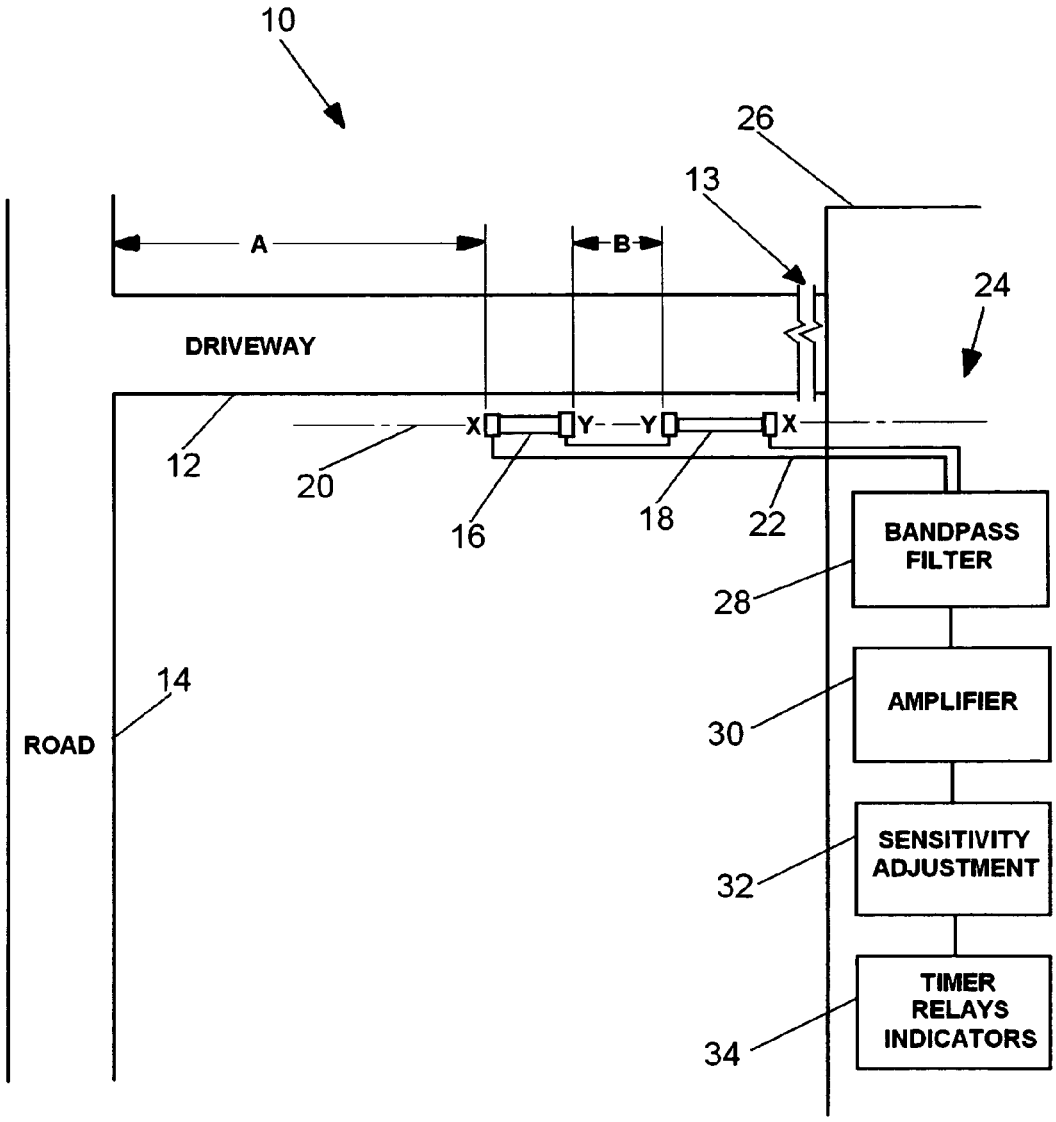
10
26
13
A
B
24
DRIVEWAY
X
Y
Y
X
12
20
16
18
22
BANDPASS FILTER
28
14
ROAD
AMPLIFIER
30
SENSITIVITY ADJUSTMENT
32
TIMER RELAYS INDICATORS
34

SHORT DRIVEWAY VEHICLE MOTION DETECTOR

BACKGROUND OF THE INVENTION

This invention deals generally with condition responsive indicating systems based on disturbances of the earth's magnetic field, and more specifically with ferromagnetic object detectors for vehicle motion detection on short driveways.

Use of the earth's magnetic field as a basis for detection of ferromagnetic objects such as vehicles is not new. U.S. Pat. Nos. 3,237,155 to Brockett and 5,877,706 to Summersgill disclose such systems which are typical of many prior art devices that convert electromagnetic fluctuations into an electronic signal for producing an indication of the movement of vehicles. The typical sensor for such systems is a coil of copper wire with a large number of turns wrapped on an iron or steel core.

The input signal for such devices is generated by the distortion of the earth's magnetic field which occurs when a large ferromagnetic object such as a vehicle moves within the magnetic field. The vehicle actually bends the magnetic lines of force near it as it concentrates those lines into its ferromagnetic body. This distortion moves along with the vehicle and can best be envisioned as an electromagnetic wave motion which causes changes in the earth's magnetic field in any location as the vehicle approaches and departs from the location. A coil of wire located in such a region of changing magnetic field has a current generated in it and a corresponding voltage developed across it in accordance with the laws of electromagnetic induction. The important characteristics of the signal generated in a passive sensing coil by the motion of a vehicle through the earth's magnetic field are that the voltages are low frequency and low amplitude. However, the strength of the generated signal varies with the distance between the vehicle and the coil, the mass of the vehicle, and the speed of the vehicle. For example, as a vehicle passes the sensor coil at a typical driveway speed of 5 miles per hour, a sine wave shaped signal of approximately 1 Hz and 1 millivolt is generated. Under various circumstances, signals can be generated in coils that are from 1 to 50 feet from a moving vehicle.

These characteristics make the use of such systems quite difficult to use for driveway detection systems. To prevent vehicles on a road adjacent to a driveway from affecting a driveway system such systems are usually installed remote from the road. The generally accepted rule is that to minimize false alarms the sensor coil should be approximately 35 feet away from the road if vehicles are traveling 35 mph and 50 feet away if the vehicles are traveling over 35 mph. The result has been that such passive magnetic coil sensor based systems are rarely used on driveways less than 75 feet long.

It would be very beneficial to have such a system that would operate satisfactorily on driveways of the typical suburban housing development.

SUMMARY OF THE INVENTION

The present invention is a vehicle motion detection apparatus that operates satisfactorily on short driveways even though it uses sensors with passive ferromagnetic detecting coils. This is possible because the preferred embodiment of the invention uses two sensor coils aligned parallel to the driveway and on a line approximately perpendicular to the adjacent road. The sensor coils are constructed, oriented, and connected so that together they cancel out the signals generated by vehicles on the road, but signals generated by a vehicle moving on the driveway are recognized and electronically processed.

This is accomplished by the sensor coil nearer to the road having its coil oriented to produce a signal of one polarity, and the second sensor coil, which is more remote from the road, is oriented to produce an opposite polarity signal. Furthermore, the sensor coil nearer to the road is designed to generate a weaker signal than the more remote sensor coil when they are subjected to the same fluctuation in magnetic field, but the more remote coil is placed in a region of less fluctuation of the earth's magnetic field. The two sensor coils are then connected in a series circuit, and only one signal is sent to the electronic circuit for processing.

Thus, when a vehicle moves along the road, the signals generated by the two sensor coils cancel each other out. This is because the sensor coil more remote from the road generates an equal and opposite signal to the sensor coil nearer to the road even though the remote sensor coil receives a somewhat smaller magnetic stimulus. However, when a vehicle is moving on the driveway the earth's magnetic field distortion affecting both sensor coils is the same because they are both the same distance from the vehicle, and the signal from the sensor coil more remote from the road is greater than the canceling signal from the sensor coil nearer to the road, so the result is a detectable net signal.

The invention thereby furnishes a vehicle motion detection system that operates reliably on short driveways.

BRIEF DESCRIPTION OF THE DRAWING

The FIGURE is a schematic diagram of the preferred embodiment of the invention.

DETAILED DESCRIPTION OF INVENTION

The FIGURE is a schematic diagram of the preferred embodiment of short driveway vehicle motion detector 10 of the invention. The placement of vehicle motion detector 10 is shown in a typical situation in which short driveway 12 is oriented at approximately 90 degrees to road 14. Driveway 12 is shown including break 13 to show that the length on the drawing is not representative of the many possible driveway lengths. Near sensor 16 and remote sensor 18 are installed, usually underground, alongside driveway 12 and on sensor line 20 which is a line that is oriented at an angle in the range of between 80 degrees and 100 degrees, but preferably at 90 degrees, to road 14. Near sensor 16 is located a distance A from road 12, and remote sensor 18 is spaced a distance B from near sensor 16. In the preferred embodiment, distance A is 10 feet, and for that distance and with the parameters described for the preferred embodiment, distance B is 2½ feet. However, distance A, the distance from the road, can actually be any distance, and the apparatus operates best when distance B is in the range of 2 to 4 feet. The actual distance between the two sensors is based on the specific design parameters of the sensors themselves.

Both near sensor 16 and remote sensor 18 are coils with multiple turns of wire wound on steel cores. In the preferred embodiment, both coils have cores that are one half inch diameter rods upon which are wound of 36 AWG copper wire of approximately 20,000 turns. The sensors are designed to have approximately the same frequency response, which is accomplished by having the same wire and number of turns, but to generate significantly different signals for the same changing magnetic field. To accomplish this difference in signal generation, near sensor 16 has a core that is 7¼ inches long, while remote sensor 18 has a core at least twice as long, 14½ inches long in the preferred embodiment. This produces a generated signal in remote sensor 18 of approximately twice that of near sensor 16 for the same magnetic field fluctuation.

The coils of the sensors are then installed to generate signals of opposite polarities, that is, as indicated in the FIGURE, end X of near sensor 16 is installed nearer to the road, while end Y of remote sensor 18 is installed nearer to the road. Therefore, when the two sensors are affected by the same fluctuation of the earth's magnetic field they generate signals of opposite polarity. The coils of the sensors are then electrically connected in series as shown, with the Y terminals connected together and the X terminals connected to the electronic circuitry. With such orientations and with remote sensor 18 located so that it is subjected to less fluctuation of the earth's magnetic field, signals of opposite polarities but essentially equal amplitude are generated in the sensors, and the series connection causes the signals to counteract each other.

If the sensor coils were identical and placed adjacent to each other, the voltages of the coils would completely cancel each other for moving vehicles on the road, and there would be no resulting signal. However, as previously described, although remote sensor 18 has greater signal generating capability, it is located at a selected distance B more remote from the road so that the signal generated by its sensor coil is approximately equal to the signal generated by near sensor 16. Thus, the two signals still cancel out for vehicles traveling on the road.

However, when a vehicle is moving on the driveway the earth's magnetic field distortion affecting near sensor 16 and remote sensor 18 is the same because they are both the same distance from the vehicle. In that situation the signal from the remote sensor 18 is greater than the canceling signal from the near sensor 16. In the preferred embodiment of the invention, when remote sensor 18 generates a signal which is approximately twice the amplitude of the signal from near sensor 16 the result is a significant detectable net signal.

Series connected near sensor 16 and remote sensor 18 are connected by cable 22 to control circuits 24, which are usually installed in a protected location such as building 26. The net signals generated by the combined signals of the sensors are thereby fed to control circuits 24. Such circuitry is assembled of conventional components. Bandpass filter 28 is used to filter out frequencies that have no relation to the signals normally generated by the sensors based on the frequencies of the expected signals. Amplifier 30 conventionally increases the signal strength so that the following electronics can also be of conventional design.

Sensitivity adjustment 32 receives the signal from amplifier 30 and can be manually adjusted to distinguish between desirable signal and extraneous signal. Sensitivity adjustment 32 can be set at a threshold level to ignore immaterial signals generated by slight mismatching of near sensor 16 and remote sensor 18 or caused by an exceptionally large vehicle moving on the road. When sensitivity adjustment 32 senses a valid signal it sends a signal to control stage 34. Control stage 34 includes one or more relays to perform any desirable action. The simplest of these actions is the production of an audible signal to indicate the movement of a vehicle in the driveway, but the actions can also include illuminating the area or any other response desired, and a timer can also be used to delay any action.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims. For example, near sensor 16 may be located at other distances from the road, and remote sensor 18 may be located farther from or closer to near sensor 16. Furthermore, the difference in the amplitude of signals generated by the sensors need not be two to one, as long as the spacing between the sensors is selected to match the difference in the generated signals. Moreover, driveway 12 need not be oriented at 90 degrees to the road, as long as the sensors are located on sensor line 20 that is oriented at an angle in the range of between 80 degrees and 100 degrees to the road. In such an arrangement detection of a vehicle on the driveway is even more certain as long as, due to a curve or angle of the driveway, the remote sensor is the sensor closer to the driveway edge.

The invention claimed is:

1. A driveway vehicle motion detector comprising:

a first sensor generating signals by reacting to the fluctuation of the earth's magnetic field caused by a moving vehicle on the driveway and comprising a multiple turn wire coil wound on a core of a first length, with the first sensor located on a sensor line that is oriented at an angle in the range of between 80 degrees and 100 degrees to the orientation of a road;

a second sensor generating signals by reacting to the fluctuation of the earth's magnetic field caused by a moving vehicle on the driveway and comprising a multiple turn wire coil wound on a core of a second length that is greater than the first length, with the second sensor located on the sensor line and farther from the road along the sensor line than the first sensor by a spacing distance, with the second sensor oriented to the road and interconnected in series with the first sensor so that the signals generated by the second sensor are of opposite polarity to the signals generated by the first sensor and counteract the signals of the first sensor; and a transmitting means feeding the combined signals generated by the series connected first sensor and second sensor to control circuits.

2. The driveway vehicle motion detector of claim 1 wherein the design and location of the second sensor are selected so that the signals generated by the second sensor cancel out the signals generated by the first sensor when a vehicle on the road passes the sensors.

3. The driveway vehicle motion detector of claim 1 wherein the first sensor is located ten feet from the road and the spacing distance between the first sensor and the second sensor is two and a half feet.

4. The driveway vehicle motion detector of claim 1 wherein the wire coils of both sensors comprise 20,000 turns.

5. The driveway vehicle motion detector of claim 1 wherein the cores of both sensors are steel rods.

6. The driveway vehicle motion detector of claim 1 wherein the second length of the core of the second sensor is at least twice the first length of the core of the first sensor.

7. The driveway vehicle motion detector of claim 1 wherein the transmitting means are wires.

8. The driveway vehicle motion detector of claim 1 wherein the control circuits include a bandpass filter.

9. The driveway vehicle motion detector of claim 1 wherein the control circuits include a sensitivity adjustment.

* * * * *